United States Patent [19]

Ikeda

[11] 4,055,615

[45] Oct. 25, 1977

[54] METHOD OF MANUFACTURING ELECTRIC RESISTORS

[76] Inventor: Yasuo Ikeda, 500, Toyoshina, Minamiazumi, Nagano, Japan

[21] Appl. No.: 506,791

[22] Filed: Sept. 17, 1974

[30] Foreign Application Priority Data

Sept. 21, 1973 Japan ..... 48-107179

[51] Int. Cl.[2] ..... G04B 35/00

[52] U.S. Cl. ..... 264/105; 264/111; 264/118; 264/122; 264/127

[58] Field of Search ..... 264/105, 111, 113, 118, 264/119, 122, 127, 157, 158, 104

[56] References Cited

U.S. PATENT DOCUMENTS

| | | | |
|---|---|---|---|
| 2,964,476 | 12/1960 | Coad | 252/511 |
| 3,027,626 | 4/1962 | Murphy | 264/118 |
| 3,076,233 | 2/1963 | Taylor | 264/127 |
| 3,351,882 | 11/1967 | Kohler et al. | 252/511 |

*Primary Examiner*—Robert F. White
*Assistant Examiner*—James R. Hall
*Attorney, Agent, or Firm*—Charles E. Pfund

[57] ABSTRACT

An electrical resistor is manufactured by molding a mixture of the powders of tetrafluoropolyethylene, carbon and metal and then sintering the molded body. Terminals comprising a mixture of a powder of tetrafluoropolyethylene and a powder of soft metal are provided by simultaneously molding a lamination of the first mentioned mixture and the second mentioned mixture.

11 Claims, 11 Drawing Figures

METHOD OF MANUFACTURING ELECTRIC RESISTORS

BACKGROUND OF THE INVENTION

This invention relates to a method of manufacturing an electric resistor suitable for use as a heating element.

Although various types of electric resistors have been proposed some of them are advantageous for certain application but not suitable for other applications and the types of the resistors are determined in accordance with their applications. For example, electric resistors used as heating elements in electric blankets are desired to have different lengths and resistance values dependent upon size, that is the length and width of the blanket. Further, as the blanket is frequently folded or bent, it is desirable that the resistor used therein should be flexible and thin. Such resistors should also be reliable, heat resistant, and able to be manufactured readily at low cost.

For this reason, certain heating elements are made of metal ribbons. However, in order to obtain a heating element of a predetermined dimension it is necessary to use a metal ribbon of a considerable length thereby complicating the manufacturing steps. Further, in order to prepare products of different configuration and electrical capacity it is necessary to prepare metal wires or riibbons of different diameter and length.

A heating element in which fine metal wires are arranged in a mesh and embedded in a plastic sheet has also been developed. In such construction weft or wrap metal wires are used for heating and since the operating voltage is applied across parallely disposed wires there is a limit for voltage control. Moreover, when the spacing between adjacent metal wires is decreased for the purpose of making uniform the temperature distribution, the number of the metal wires is increased. Then, to assure the same power consumption or the rated power capacity it is necessary to reduce the diameter of the metal wire. Accordingly, it is necessary to prepare metal wires of different diameter for the purpose of manufacturing heating elements of different ratings.

Even when a number of wires of different diameters are prepared it is difficult to manufacture products of the desired dimension, size, thickness, configuration and electric capacity. In addition, it is difficult to obtain desired resistance values which vary over a wide range depending upon the application of the product. In other words, with the conventional resistance elements it is difficult to obtain products of any desired configuration and power rating unless an elaborate manufacturing facility is installed. The same problem exists in resistors utilized for other purpose than heating.

Terminals for connecting the resistors to other circuit components have been secured to the opposite ends of the resistors by mechanical means or welding. However, such methods are not only troublesome but also cannot eliminate the contact resistance between the resistors and the terminal fittings.

SUMMARY OF THE INVENTION

Accordingly, it is an object of this invention to provide an improved method of manufacturing electric resistors.

Another object is to provide an improved method of manufacturing electric resistors having a high heat resistance and which can be readily fabricated.

Still another object of this invention is to provide a new and improved method of manufacturing electric resistors capable of producing resistors having any desired resistance values or current ratings.

A further object of this invention is to provide a method of manufacturing electric resistors capable of readily forming resistors of any desired shape.

Still further object of this invention is to provide a method of manufacturing electric resistors capable of readily forming flat resistors.

Another object of this invention is to provide a novel method of manufacturing electric resistors capable of readily bending or deforming in accordance with the mounting positions, or conditions of use.

Another object of this invention is to provide a method of manufacturing electric resistors at a low cost.

Still another object of this invention is to provide a novel method of manufacturing electric resistors wherein the terminals are formed concurrently with the resistors.

According to one aspect of this invention there is provided a method of manufacturing an electric resistor, characterized in that a powder of tetrafluoropolyethylene, a powder of carbon, and a powder of metal are mixed together, that the ratio of the sum of the powders of the metal and carbon to the tetrafluoropolyethylene is less than 30% by volume, that the resulting mixture is charged in a metal mold and molded under pressure and that the moulded body is sintered.

According to another aspect of this invention there is provided a method of manufacturing an electrical resistor, characterized in that a first mixture of a powder of tetrafluoropolyethylene, a powder of carbon and a powder of metal is prepared, that the ratio of the sum of the carbon and metal to the tetrafluoropolyethylene is less than 17% by volume, that a second mixture of a powder of tetrafluoropolyethylene and a powder of electroconductive metal is prepared, that said first and second mixtures are charged into a metal mold a predetermined order and molded under pressure, and that the molded body is sintered.

The first mixture is used to form a resistor body and the second mixture is used to form terminals, so that according to the latter method it is possible to produce a resistor having integral terminals on the opposite ends thereof. Similarly, a resistor having terminals on the opposite ends and at an intermediate point can also be formed. A hollow cylindrical resistor block is sliced to form annular resistor or cut spirally along the periphery to obtain a web shaped resistor.

DESCRIPTION OF THE PREFERRED EMBODIMENT

Figure 1:
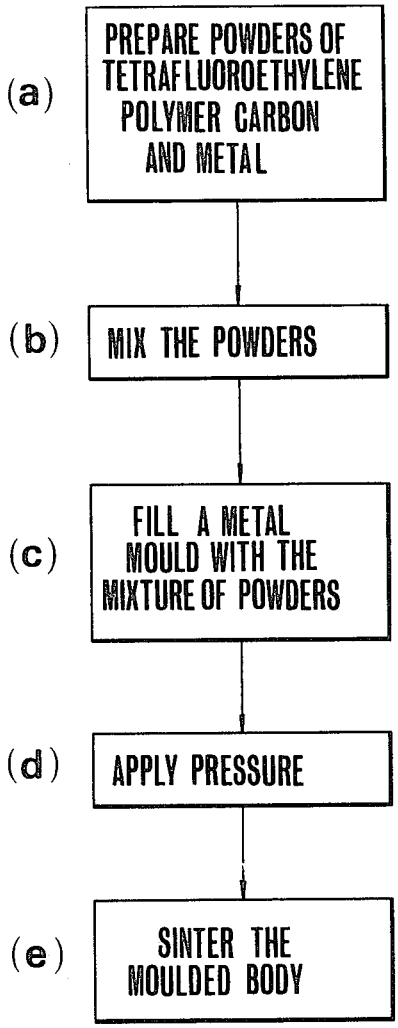
FIG. 1 is a flow chart showing successive process steps of the method of this invention.
Figure 2A:
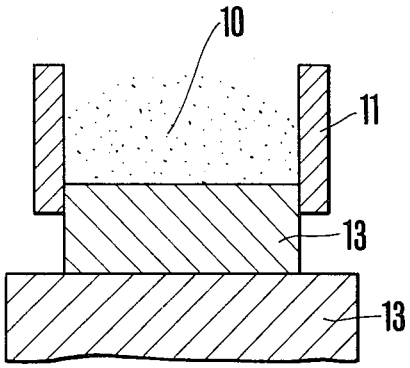
FIGS. 2A and 2B are sectional views of a mold at different steps shown in FIG. 1.
Figure 2B:
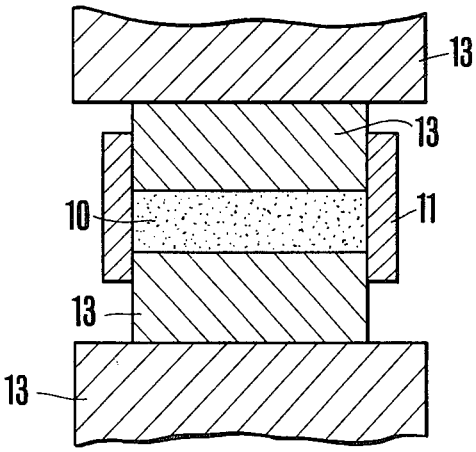
Figure 3A:
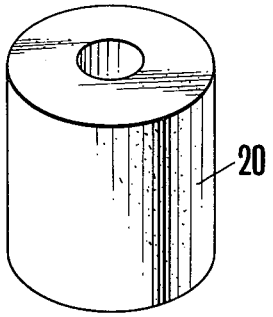
FIG. 3A is a perspective view of a resistor block obtained by the method of this invention.

The basic steps of this invention will firstly be described with reference to the flow chart shown in FIG. 1. As shown by step a, powders of tetrafluoropolyethylene $(CF_2\text{-}CF_2)n$, carbon and metal such as brass, silver and gold, are prepared and then these powders are mixed with each other as shown by step b. The percentage of the mixture of the carbon and metal to the powder of tetrafluoropolyethylene is limited to be less than 30% by volume. Then, in step c, the resulting mixture 10 is placed in a metal mold 11 as shown in FIG. 2A, and then the mixture 10 is compressed by applying pressure thereto by plungers 13. The compressed body is taken out from the mold and is then sintered, preferably at a temperature of from 320°–390° C thus producing a hollow cylindrical resistor block 20 as shown in FIG. 3A.

Figure 3B:
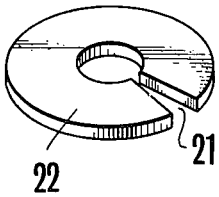
FIGS. 3B and 3C are perspective views showing tow examples of the resistors prepared from the resistor block shown in FIG. 3A.
Figure 3C:
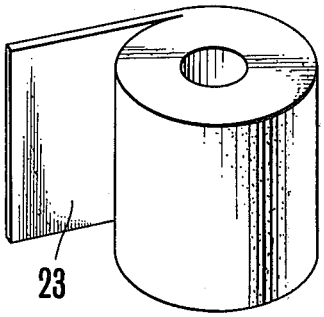

Tetrafluoropolyethylene (Trade mark Teflon) utilized in this invention is a thermosetting resin having high heat resistance and sufficient flexibility. The polymer can be readily worked as by cutting after hardening. Accordingly, it is possible to obtain an annular resistor 22 (FIG. 3B) by slicing the resistor block 20 into an annular form, then forming a radial slot 21 and forming electrodes on the opposite sides of the slot. Alternatively, the resistor block 20 may be cut spirally along its peripheral surface to form a flat sheet resistor 23 as shown in FIG. 3C. By varying the thickness of the annular body or flat sheet it is possible to obtain resistors having any desired resistance value. The current capacity of the resistor can also be readily adjusted by varying the thickness and length of the resistor.

As described above since tetrafluoropolyethylene is used, the resistor manufactured by the method of this invention has sufficient flexibility so that it is possible to bend or deform in accordance with the mounting position and the condition of use.

A desired resistance value or current capacity suitable for a particular application can readily be obtained by varying the thickness or length of a resistor cut from the resistor body 20 prepared by mixing the powders of three raw materials, molding sintering the resulting mixture. Thus, it will be clear that no special manufacturing facility is necessary to prepare resistors of different resistance values or current capacities, and that according to the method of this invention resistors of different forms and ratings can be prepared at low cost.

To have better understanding of the invention, the following examples are given.

EXAMPLE 1

To a powder of tetrafluoropolyethylene was added a mixture of powders of silver and carbon at a ratio of 8 : 2 by volume. The ratio of silver powder to carbon powder may also be 8 : 2 by volume. Five percent the silver powder has a particle size of 250 to 350 mesh and the remaining proportion has a particle size larger than 350 mesh. The particle size of the carbon powder is larger than 600 mesh. The mixture was stirred for about 20 minutes in a hammer mixer.

After charging in a mold 11 shown in FIG. 2A, the mixture was compressed by a pressure of 650 kg/cm$^2$ and the plungers 13 were moved at a speed of 5 mm/min. After stopping the plungers, the mixtures was maintained for two minutes under pressure. The molded body was removed from the mould and then sintered at a temperature of from 370° to 380° C for an interval at a rate of one hour per 2.54 cm of the radial thickness of the sintered body, thereby obtaining a resistor block 20 as shown in FIG. 3A.

Where a tape shaped resistor having a thickness of 0.1 mm and a width of 50 mm was formed by cutting spirally the resistor block in a manner as shown in FIG. 3C, the resistor had a resistance value of 2.5 ohms per meter.

EXAMPLE 2

The same process steps as in Example 1 were repeated except that the ratio of the silver powder to the carbon powder was varied to 1 : 9 by volume. A tape shaped resistor was produced having a resistance of 3.5 ohms per meter.

EXAMPLE 3

In this example, the ratio of the silver powder to the carbon powder was varied to 6 : 4 by volume. Other conditions were the same as in Example 1. The resistor of this Example had a resistance of 15 ohms per meter.

EXAMPLE 4

The same process steps as in Example 1 were followed except that the ratio of the silver powder to the carbon powder was varied to 2 : 8 by volume, and obtained a resistor having a resistance of 136 ohms per meter.

The result of various experiments shows that the objects of the invention described above can be accomplished only when the percentage of the mixture of the poweder of metal and carbon is less than 30% of the powder of tetrafluoropolyethylene. When the amount of the mixture of metal and carbon exceeds 30% the resulting resistor block becomes brittle thus making it difficult to work. Best flexibility can be attained when the amount of the mixture of metal and carbon is about 15 to 16% based on the volume of tetrafluoropolyethylene. When said percentage becomes less than 5%, the resistance becomes too high (more than several hundreds kiloohms) so that resulting resistors are not suitable to use a heating elements.

While pressure is applied during molding for the purpose of eliminating air voids in the molded product, if continuing pressure is applied in a short time it would be difficult to remove the molded product from the metal mold. A pressure of from 600–700 Kg/cm$^2$ is preferred for eliminating the air voids. A preferred time interval for the application of pressure during molding is 5–7 minutes. This pressure dependent upon the physical properties of the product, thus requiring a larger pressure as the hardness of the resulting resistor increases. For this reason, soft metals are preferred such as copper, silver and gold.

Figure 4:
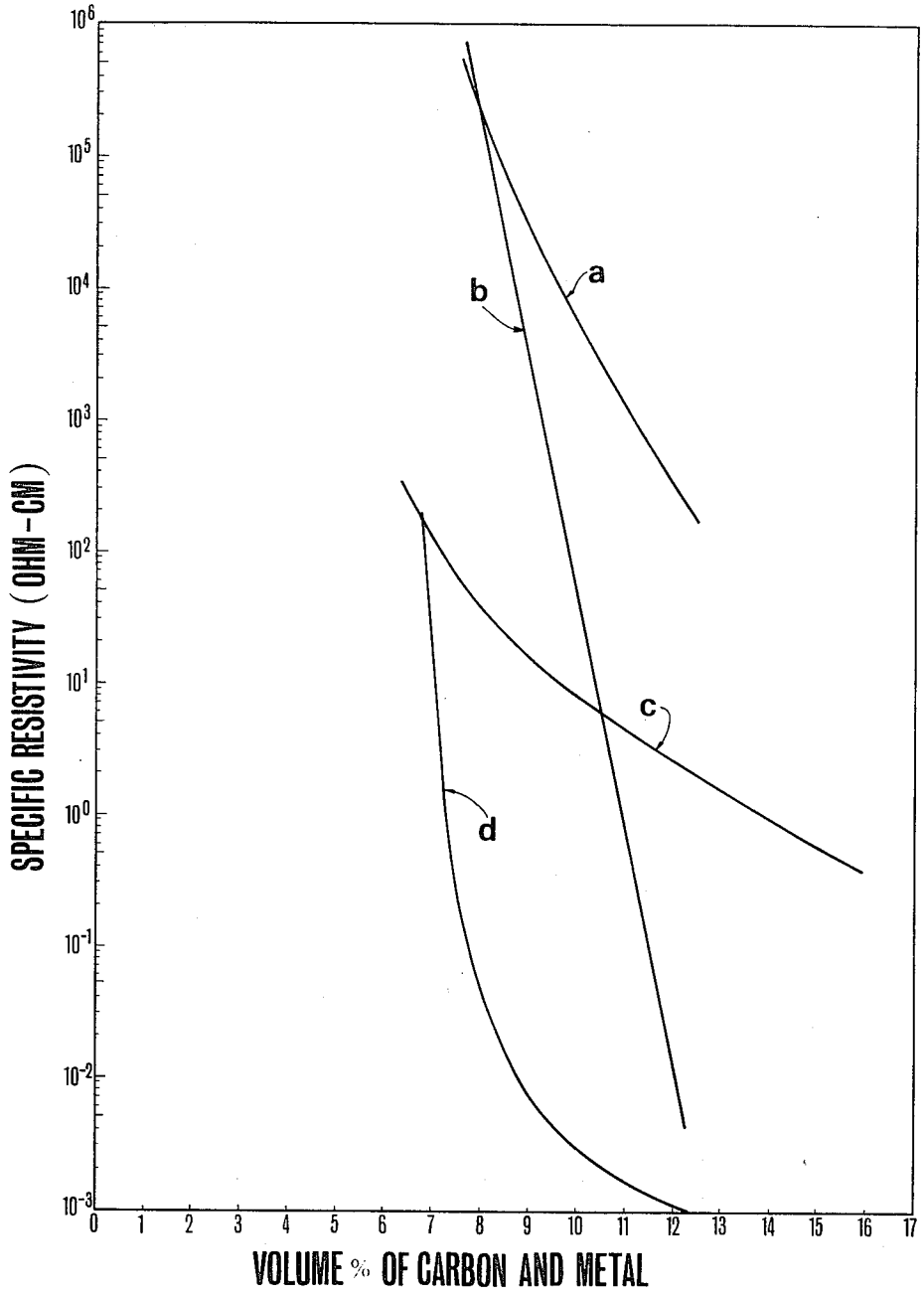
FIG. 4 is a characteristic of the resistor manufactured by the novel method showing the relationship of specific resistivity and the ratio of carbon powder and metal (copper) powder which are admixed with tetrafluoroethylene polymers.

FIG. 4 shows a characteristic of the resistor manufactured by the method of this invention together with the characteristics of a resistor comprising a mixture of the powders of carbon and tetrafluoroethylene polymer and of a resistor comprising a mixture of the powders of copper and tetrafluoropolyethylene. In FIG. 4 the abscissa shows the percentage by volume of the substance incorporated in the tetrafluoroethylene polymer and the ordinate the resistance value of the resulting resistors. Curves a and b show the characteristics of the resistors manufactured by the method of this invention. Curve a was obtained by varying the amount of the carbon powder while maintaining the amount of the metal powder at 5%, by volume, whereas curve b was obtained by varying the amount of the metal powder while maintaining the amount of the carbon powder at 5%, by volume. The particle size of carbon and metal and other conditions of manufacturing were the same as those used in Example 1 except that copper particles plated with 3% silver were used. Curve c shows the characteristic of a resistor comprising a mixture of tetrafluoroethylene polymer and carbon powder, but not containing the metal powder, whereas curve d shows that of a resistor comprising tetrafluoropolyethylene and a copper powder but not containing the carbon powder. These curves show that the resistance of the resistors manufactured by the method of this invention varies uniformly as the amount of carbon and metal varies so that it is possible to manufacture resistors having resistance varying uniformly over a wide range.

Where plate shaped resistors for use as heating elements are manufactured it is advantageous to cover the surface of the resistors with heat resistannt electric insulators such as tetrafluoroethylene-hexafluoropropylene copolymers, mica and polyimide.

Figure 5A:
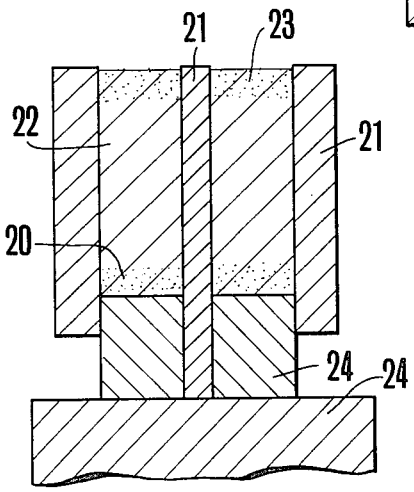
FIGS. 5A and 5B are sectional views of a mold utilized to manufacture a resistor having terminals provided by the method of this invention.
Figure 5B:
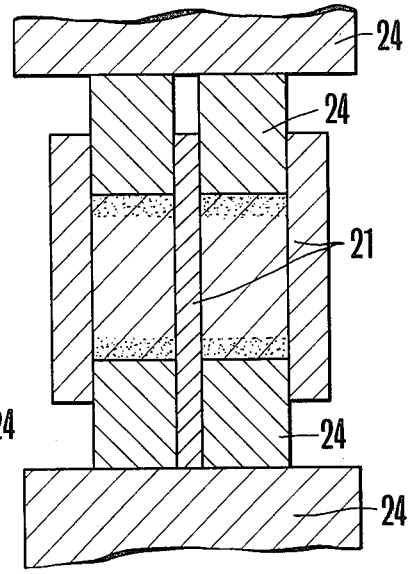

FIG. 5 shows a modified method wherein the terminals are formed concurrently with the molding of the resistor block comprising a mixture of tetrafluoropolyethylene, a powder of carbon and a powder of metal described above. The terminals are made of a mixture of a powder of tetrafluoropolyethylene and a powder of highly electroconductive metal such as copper, gold and silver. As shown in FIG. 5A, a mixture 20 for forming one terminal is firstly charged in a metal mold 21, then a mixture 22 for forming the resistor is charged on the mixture 20. Finally, a mixture 23 for forming the other terminal is charged on the mixture 22. After applying a suitable pressure by means of plungers 24, as shown in FIG. 5B, the mold body is sintered. By cutting the resulting resistor block along its periphery, it is possible to form a web shaped resistor 28 having terminals 26 and 27 along its opposite edges.

In preparing the terminals 26 and 27 the ratio of the powder of metal to tetrafluoropolyethylene is made to be higher than 12%. With this ratio a specific resistivity of about 0.03 ohm-cm was obtained. The conditions of pressure molding sintering are the same as those of manufacturing the resistor. In addition to the powders of gold, silver and copper, powders of electro-conductive metal, copper for example, plate with 3 to 12%, by volume, of silver can also be used. It is also possible to use any suitable combinations of other metals.

Figure 6:
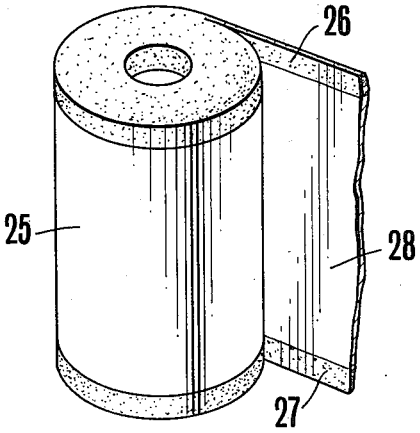

By the method described in connection with FIGS. 5 and 6, it is possible to form the terminals concurrently with the molding of the resistor block and to manufacture resistors with terminals by merely cutting the resistor block. In this manner, as the terminals are molded integrally with the resistor it is possible to greatly reduce the contact resistance bwtween the terminals and the resistor whereby heating of the contact portion can be avoided.

Figure 7:
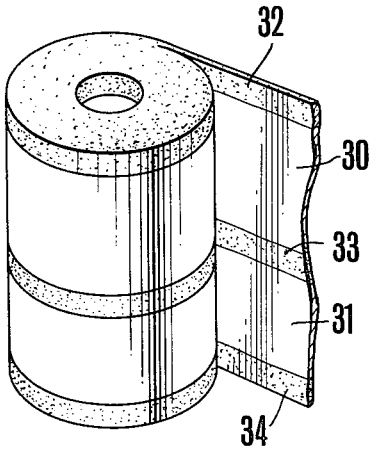
FIGS. 6 and 7 are perspective views showing two different methods of forming flat resistors from the resistor block prepared by the steps shown in FIGS. 5A and 5B.

In a modified embodiment shown in FIG. 7 two resistors 30 and 34 with two opposite terminals 32 and 34 and one intermediate terminal 33 were prepared by a method similar to that shown in FIGS. 5A and 5B. The intermediate terminal 33 may be positioned at any intermediate point.

It should be understood that the invention is not limited to the specific embodiments described above. For example the metal powder may take the form of flakes of square or polygonal form. Further, the particle size of the metal powder and carbon powder may be different from those described above.

What is claimed is:

1. A method of manufacturing a thin, flat, flexible electrical resistor heating element for use in electric blankets, said method comprising the steps of:

a. mixing tetrafluoropolyethylene powder and a mixture of carbon powder and metal powder to form an admixture, said mixture of carbon and metal powders not exceeding 30% by volume of said tetrafluoropolyethylene powder in said admixture;

b. charging said powder admixture in a metal mold;

c. compressing said powder admixture in said mold for a sufficient time interval to eliminate air voids and bond said powder admixture into a compressed body;

d. removing said compressed body from said mold;

e. sintering said compressed body to form a sintered body; and f. cutting said sintered body into at least one flat, flexible electrical resistor.

2. The method according to claim 1 wherein said metal is selected from group consisting of copper, silver, gold and brass.

3. The method according to claim 1 wherein said powder of metal is in the form of flakes.

4. The method according to claim 1 wherein said compressed body is sintered at a temperature of from 320° C to 390° C.

5. The method according to claim 1 wherein said molding is performed under a pressure of from 600 to 700 kg/cm$^2$.

6. The method according to claim 1 wherein said interval ranges from 5 to 7 minutes.

7. The method according to claim 1 wherein a hollow cylindrical sintered body is formed, the body is sliced into annular discs, and the annular discs are then formed with radial gaps thereby forming substantially annular resistors.

8. A method according to claim 1 wherein a hollow cylindrical sintered body is formed and then the cylindrical sintered body is cut spirally along its periphery to form a flexible web-shaped resistor.

9. A method of concurrently manufacturing a thin, flat, flexible electrical resistor and integral terminals for use in electric blankets, said electric resistor having a resistance value sufficiently high to serve as a heating element and said terminals having a substantially lower resistance value to avoid heating thereof, said process comprising the steps of:

a. mixing tetrafluoropolyethylene powder and a mixture of carbon powder and metal powder to form a first admixture to be formed into said flexible resistor, said mixture of carbon and metal powders not exceeding 17% by volume of said tetrafluoropolyehtylene powder in said first admixture;

b. mixing tetrafluoropolyethylene powder and electroconductive metal powder to form a second admixture to be formed into said terminals;

c. charging said first and second powder admixtures in a metal mold in a predetermined order such that said first powder admixture is located between spaced portions of said second powder admixture to form a powder admixture body;

d. compressing said powder admixture body in said mold for a sufficient time interval to eliminate air voids and bond said first and second powder admixtures into a compressed body;

e. removing said compressed body from said mold;

f. sintering said compressed body to form a sintered body; and g. cutting said sintered body into at least one flat, flexible electrical resistor with integral spaced terminals.

10. The method according to claim 9 wherein the amount of said electroconductive metal in said second mixture is selected to be more than 12%, by volume, of the amount of said tetrafluoropolyethylene.

11. The method according to claim 9 wherein a cylindrical sintered body is formed and then the sintered body is cut spirally along the periphery thereof to form a flexible web-shaped resistor with integral terminals on the opposite side edges thereof.

* * * * *